United States Patent [19]

McArdle et al.

[11] 4,182,945

[45] Jan. 8, 1980

[54] PUSH-UP LIPSTICK OR THE LIKE CONTAINER

[75] Inventors: James M. McArdle, Cheshire; Edward F. Klimeck, Waterbury, both of Conn.

[73] Assignee: Eyelet Specialty Co., Inc., Wallingford, Conn.

[21] Appl. No.: 946,970

[22] Filed: Sep. 29, 1978

[51] Int. Cl.[2] ..... A45D 40/00

[52] U.S. Cl. ..... 206/385; 132/79 C

[58] Field of Search ..... 206/385; 132/79 C, 88.7; 30/162; 222/510, 409; 401/99, 100, 31, 32

[56] References Cited

U.S. PATENT DOCUMENTS

| | | | |
|---|---|---|---|
| 1,576,567 | 3/1926 | Buhl-Bonanno | 132/79 C |
| 2,043,250 | 6/1936 | Kasdan et al. | 132/79 C |
| 2,049,378 | 7/1936 | Holl | 206/385 X |
| 2,458,020 | 1/1949 | Olsen | 206/385 X |
| 2,512,476 | 6/1950 | Birnkrant et al. | 206/385 X |
| 2,610,732 | 9/1952 | Calhoun | 206/385 X |
| 3,802,444 | 4/1974 | Pensabene | 132/79 C |

*Primary Examiner*—Joseph Man-Fu Moy

*Attorney, Agent, or Firm*—Hopgood, Calimafde, Kalil, Blaustein & Lieberman

[57] ABSTRACT

The invention contemplates a lipstick or the like container of the push-up variety featuring enhanced protection of container contents and enchanced light frictional coaction between moving parts, for ease of motional action and retention of selected positioning of parts. An upstanding elongate guide member within the container is stabilized to the container at both ends and serves both the indicated features.

11 Claims, 8 Drawing Figures

PUSH-UP LIPSTICK OR THE LIKE CONTAINER

This invention relates to an improved push-up lipstick or the like container and is particularly applicable to such containers of all-plastic or of substantially all-plastic construction.

Past push-up lipstick or the like containers have been noticeably lacking in ability to protect container contents against undue ingress of foreign matter and have been less than satisfactory in regard to smoothness of action and firmness of position retention. And, in the case of plastic push-up containers, the nature of design and construction has been such as to preclude such features, within the severe cost limitations which apply to push-up containers.

It is accordingly an object of the invention to provide an improved container of the character indicated, substantially overcoming the noted shortcomings of prior containers.

It is a specific object to provide a push-up container construction utilizing primarily injection-molded plastic parts and providing enhanced protection of container contents.

Another specific object is to meet the above objects with superior carrier-displacement action.

A further specific object is to provide such a container which does not rely on the container body per se to stabilize or pilot the carrier in its displaceable course.

A general object is to provide such a container of simple and inexpensive construction, lending itself to ready assembly and to foolproof action for the life of the contents of the container.

Other objects and various further features of novelty and invention will be pointed out or will occur to those skilled in the art from a reading of the following specification in conjunction with the accompanying drawings. In said drawings, which show, for illustrative purposes only, a preferred form of the invention:

Figure 1:
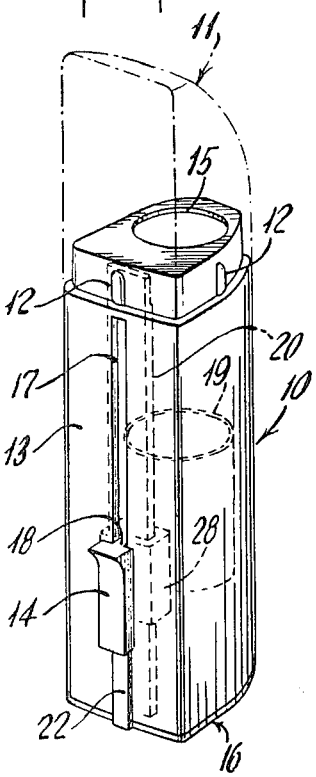
FIG. 1 is a perspective view of a container of the invention, with its closure cap in phantom, and with important internal parts shown in lightly-dashed outline.
Figure 3:
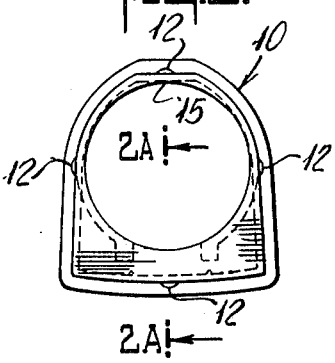
FIGS. 2 and 3 are respectively elevation and plan views of a body part of the container of FIG. 1.

In FIG. 1, the invention is shown in application to a push-up lipstick or the like container comprising a body 10 and a detachably removable cover cap 11, the latter being shown only in phantom outline, to permit better visibility as to the body 10. Nibs 12 at the reduced upper end of body 10 provide frictional retention of cap 11, in the container-closed condition. Body 10 is elongate and generally tubular, with a decorative noncircular external contour which enables quick recognition of a generally flattened and elongate side 13, against which an actuating tab element 14 is exposed for ready thumb engagement; the remaining external body contour is shown in FIG. 3 to be generally rounded or ogival, for finger-grasping convenience. The body 10 has a circular opening 15 at its upper end, through which lipstick pomade or the like material is selectively dispensable, and is closed by a base 16 at its lower end. An elongate access slot 17 in side 13 receives a neck portion 18 by which tab 14 is directly coupled to a carrier cup 19 for the pomade which is to be stored in and dispensed from the container.

In accordance with a feature of the invention, an upstanding elongate guide member 20 is stabilized to the container at both ends and serves both as a smooth-acting guide or pilot for actuated motion of the carrier and as part of a labyrinth-like closure of slot 17, i.e., to guard against undue entrance of foreign matter into the inner volume of the container. As shown, guide member 20 is relatively thin and flat, being formed integrally with the inner platform of the base 16. A short and rectangularly prismatic reinforcement 22 is narrow to fit opposite edges of the lower end of body slot 17 and also integrally reinforces the connection of guide member 20 to the base 16. Thus, base 16 and guide member 20 constitute a single part, which is preferably injection-molded of suitable plastic, such as polypropylene or high-density polyethylene. Preferably, and for a purpose later to be made clear, the sectional width-to-thickness ratio W/T of guide member 20 is such as to enable a degree of stiffly compliant bending about a central longitudinal axis, while maintaining an orientation parallel to but offset behind side 13, for the full effective length of member 20; it will also be noted that the width W of member 20 substantially exceeds the width of slot 17 and that it is in symmetrical overlap with both edges of slot 17.

Figure 2A:
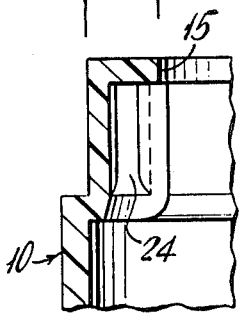
FIG. 2A is an enlarged fragmentary sectional view, taken at 2A—2A in FIGS. 2 and 3.
Figure 2:
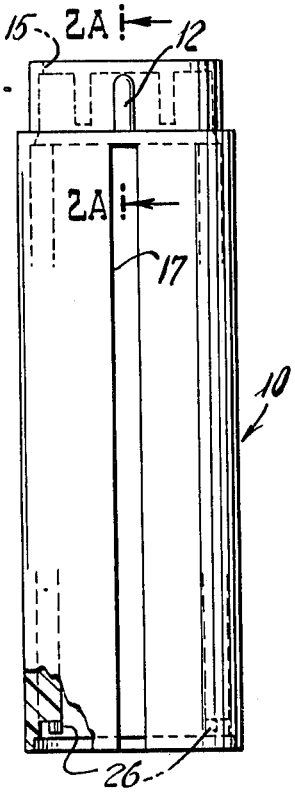
Figure 6:
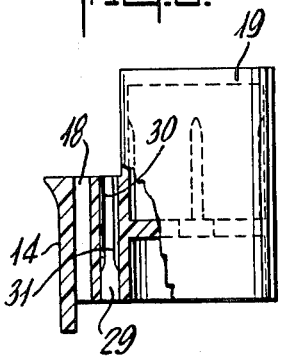
FIG. 6 is a view in side elevation of the carrier of FIG. 5, a portion being broken-away and shown in vertical section.
Figure 4:
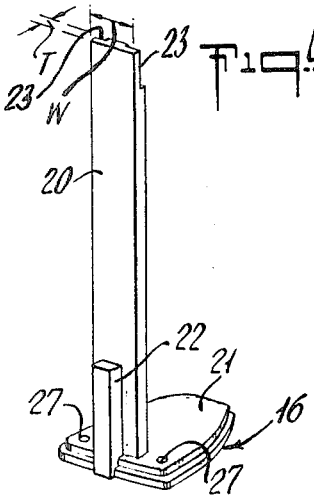

To complete the description of guide member 20, we note that it is retained by interlocking formations 23–24, on member 20 and within the reduced upper end of body 10, upon assembly of the parts of FIGS. 2—3 and 4 to each other, noting socket formations 24 in FIG. 2A to receive and locate the inserted notched end formations 23 of member 20. As to body shell 10, it is seen in FIG. 2 that slot 17 extends all the way to the lower edge, permitting assembly to the reinforcement 22 and body-skirt seating upon a peripheral recess or shoulder at base 16. Also, as body 10 homes into final assembled relation to base 16, longitudinal body projections 26 have telescoping entry into locating sockets 27 in the platform 21. As with the base and guide part of FIG. 4, the body 10 of FIGS. 2, 2A and 3 is preferably a single injection-molded part of suitable plastic; both these parts may be of the same material, which is adaptable to localized sonic or heat welding, or to use of suitable adhesive to retain the indicated two-part body assembly.

Figure 5:
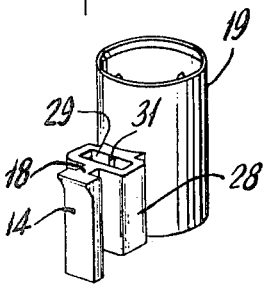
FIGS. 4 and 5 are perspective views of coacting internatal guide and carrier parts of the container of FIG. 1.
Figure 7:
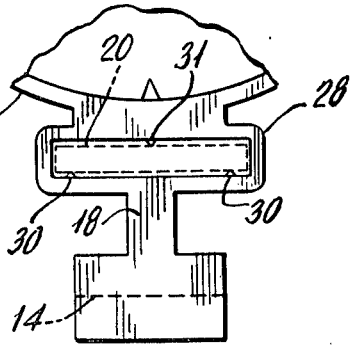
FIG. 7 is an enlarged fragmentary plan view of actuating and guide elements of the carrier of FIGS. 5 and 6.

Of course, prior to body assembly, the carrier part of FIG. 5, again preferably a single injection-molded plastic part, is assembled to guide member 20. To this end, the connection of tab neck 18 to cup 19 integrally comprises a sleeve formation 28, defining an internal opening 29 of sectional proportions corresponding generally to the described sectional profile of guide member 20; opening 29 is preferably longitudinally elongate for continuous stable orientation of cup 19 throughout its range of motion along member 20. Pre-assembly of carrier 19 to guide member 20 is readily accomplished, and a light frictional resistance and smooth action characterize the relative motion. Such resistance and action flow from a slight interference-fit relation between the coacting parts, a preferred embodiment of such relation being apparent from FIG. 7, when two laterally spaced elongate ribs 30 along one of the flat inner walls of opening 29 engage the adjacent surface of member 20, and while a single and centrally located elongate rib 31 along the other flat inner wall of opening 29 engages the adjacent (opposite) surface of member 20. When an interference fit is established between member 20 and the three ribs 30–31, member 20 is stiffly compliantly deformed (about a central longitudinal axis of member 20) to maintain a resilient preload of the interference fit. And it will be understood that with a sufficient preload of this nature, any vertical positioning of carrier 19 is retained, while the self-lubricating property of the coacting plastic parts assures smooth sliding action in response to actuation at tab 14.

It goes without saying that assembly of the three plastic injection-molded parts is the essence of simplicity, the base (16)-to-body (10) connection being rendered permanent by adhesive or welding techniques of the character indicated, all following preassembly of carrier sleeve 28 to guide member 20. Running clearances are preferably designed into neck portion 18 with respect to adjacent surfaces of body 10 at slot 17. Also, carrier 19 preferably clears all inner-wall surfaces of body 10, so that total or substantially total reliance is placed on the described relation between sleeve portion 28 and guide member 20.

The described container will be seen to have achieved all stated objects and to have achieved a superior product which is not only smooth and positive as to action and retaining capability, but is also characterized by enhanced resistance to ingress of foreign matter.

While the invention has been described in detail for a preferred form, it will be understood that modifications may be made without departure from the scope of the invention.

What is claimed is:

1. A "push-up" lipstick or the like container, comprising a tubular body having an open upper end and a closed lower end, said body having an elongate relatively narrow slot providing external access to the interior of said body, an elongate guide member of substantially uniform width greater than the width of said slot and carried by said body at one of the ends of said body and at a location which positions said guide member within said body and in overlap with said slot but at radially offsetting clearance with the body wall at said slot, and a carrier member longitudinally movable in said body, said carrier member including a manual actuating tab extending through said slot, said tab having guide-piloting formations engaged to and deriving guided support from said guide member.

2. The container of claim 1, in which said guide-piloting formations include an action-stabilizing projection extending into light frictional interference-fit relation with a portion of said guide member.

3. The container of claim 1, in which coacting position-stabilizing formations are engaged at the other end of said body and guide member.

4. The container of claim 1, in which said body includes a base from which said guide member derives upstanding cantilevered support.

5. The container of claim 4, in which said base and guide member are a single integral part, said body having an open lower end which is closed by fitted assembly of said base thereto.

6. The container of claim 5, in which the upper end of the bore of said tubular body includes guide member locating formations engaged with the upper end of said guide member.

7. The container of claim 1, in which the guide-piloting formations of said tab are defined by the inner wall of a sleeve-forming opening through said tab, said opening conforming to the sectional contour of said guide member.

8. The container of claim 7, in which said guide member and opening are of relatively thin and flat generally rectangular configuration, and position-stabilizing frictional projections on the inner confines of the tab opening and having frictional interference-fit relation with at least one of the relatively flat sides of said guide member.

9. The container of claim 8, in which said frictional projections engage opposite flat sides of said guide member at laterally offset locations.

10. The container of claim 9, in which each of said projections is a rib that is elongate in the longitudinal direction of carrier displaceability.

11. The container of claim 10, in which the number of ribs is three, two being at laterally spaced locations and frictionally engaged with one of the relatively flat sides of said guide member, the remaining one of said three ribs being intermediate said laterally spaced locations and frictionally engaged with the opposite relatively flat side of said guide member.

* * * * *